US006279779B1

(12) United States Patent
Laciacera et al.

(10) Patent No.: US 6,279,779 B1
(45) Date of Patent: Aug. 28, 2001

(54) CLOSABLE OPENING DEVICE FOR SEALED PACKAGES OF POURABLE FOOD PRODUCTS

(75) Inventors: Mauro Laciacera, Modena; Claudia Miani, Bologna, both of (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/597,821

(22) Filed: Jun. 19, 2000

(30) Foreign Application Priority Data

Oct. 1, 1999 (EP) ..... 99830622

(51) Int. Cl.[7] ..... B67D 5/00
(52) U.S. Cl. ..... 222/83; 222/81; 222/541
(58) Field of Search ..... 222/81, 83, 83.5, 222/91, 541, 541.2

(56) References Cited

U.S. PATENT DOCUMENTS

| | | | | |
|---|---|---|---|---|
| 4,109,814 | | 8/1978 | Rausing . | |
| 4,140,235 | | 2/1979 | Rausing et al. . | |
| 4,948,015 | | 8/1990 | Kawajiri et al. . | |
| 5,020,690 | * | 6/1991 | Kishikawa et al. | 222/83 |
| 5,141,133 | * | 8/1992 | Ninomiya et al. | 222/83 |
| 5,147,070 | * | 9/1992 | Iwamoto | 222/83 |
| 5,297,696 | * | 3/1994 | Berstein et al. | 222/83 |
| 5,947,318 | | 9/1999 | Palm . | |

FOREIGN PATENT DOCUMENTS

| | | |
|---|---|---|
| 43 43 816 | 6/1995 | (DE) . |
| 2 765 194 | 12/1998 | (FR) . |
| 8 11873 | 1/1996 | (JP) . |
| 95/05996 | 3/1995 | (WO) . |

* cited by examiner

*Primary Examiner*—Philippe Derakshani
*Assistant Examiner*—Thach H Bui
(74) *Attorney, Agent, or Firm*—Burns, Doane, Swecker & Mathis, L.L.P.

(57) ABSTRACT

A closable opening device (2) having a frame (15) defining a through hole (16) and fitted about a pierceable portion (4) of a sealed package (1) for pourable food products; a removable threaded cap (17) which screws onto the frame (17) to close the hole (16); and a tubular cutting member (18), which engages the hole (16) in movable manner along a spiral feed path, is connected angularly to the cap (17) during disengagement of the cap (17) from the frame (15) when first opening the package (1), and has an end edge (40) in turn having, on the face, a single cutter (55) acting along a major portion (C) of the periphery of the pierceable portion (4) to open the package (1).

14 Claims, 6 Drawing Sheets

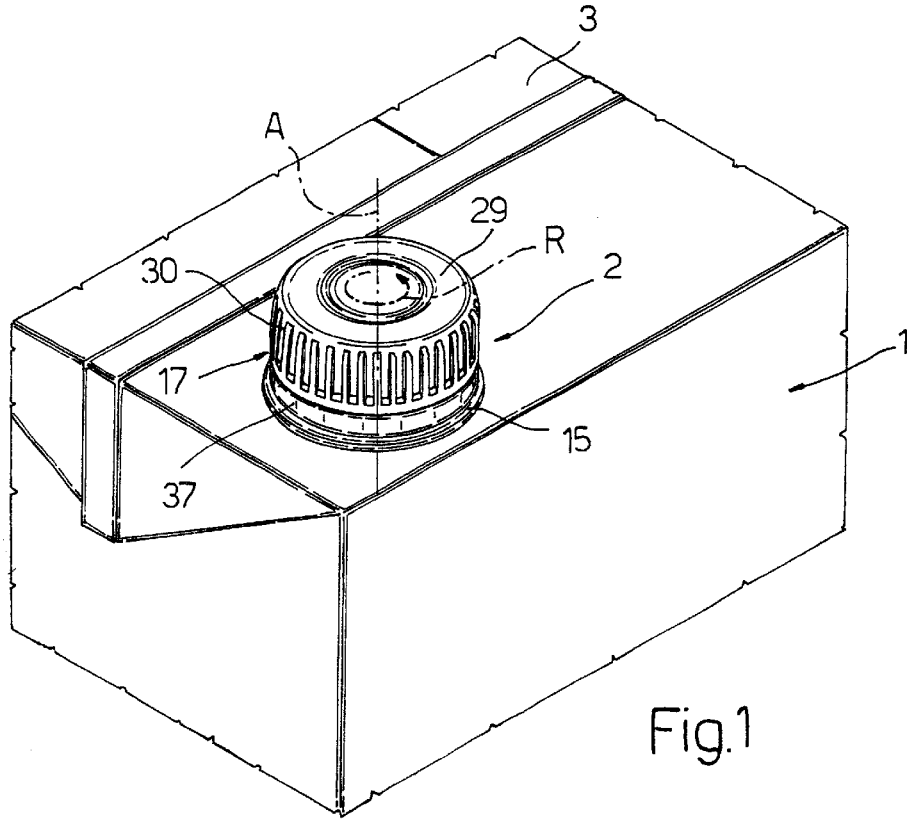
Fig.1
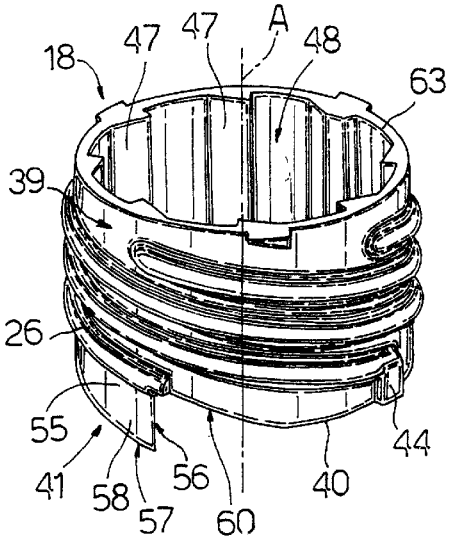
Fig.13
Fig.4
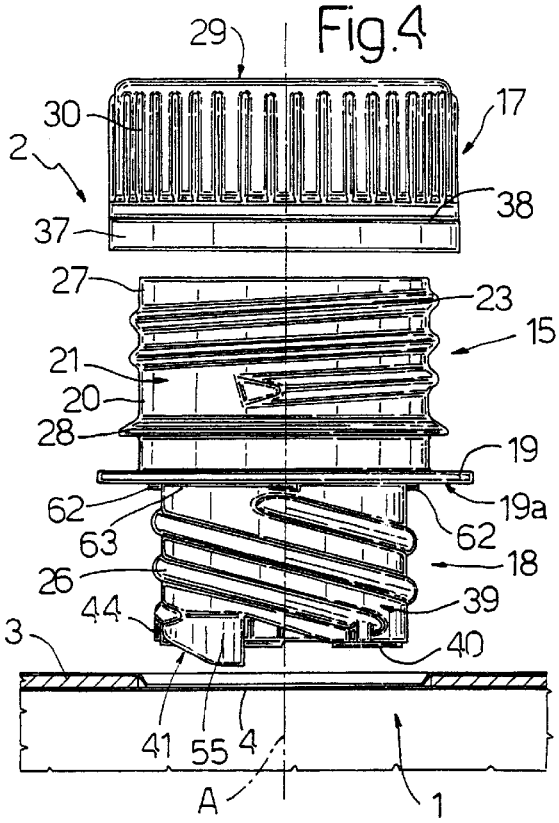

CLOSABLE OPENING DEVICE FOR SEALED PACKAGES OF POURABLE FOOD PRODUCTS

This application claims priority under 35 U.S.C. §§119 and/or 365 to Appln. No. 99830622.9 filed in Europe on Oct. 1, 1999; the entire content of which is hereby incorporated by reference.

FIELD OF THE INVENTION

The present invention relates to a closable opening device for sealed packages of pourable food products.

BACKGROUND OF THE INVENTION

As is known, many pourable food products, such as fruit juice, UHT (ultra-high-temperature processed) milk, wine, tomato sauce, etc., are sold in packages made of sterilized packaging material.

A typical example of such a package is the parallelepiped-shaped package for liquid or pourable food products known as Tetra Brik Aseptic (registered trademark), which is formed by folding and sealing laminated strip packaging material. The packaging material has a multilayer structure comprising a layer of fibrous material, e.g. paper, covered on both sides with layers of heat-seal plastic material, e.g. polyethylene, and, in the case of aseptic packages for long-storage products, such as UHT milk, also comprises a layer of oxygen-barrier material defined, for example, by an aluminium film, which is superimposed on a layer of heat-seal plastic material and is in turn covered with another layer of heat-seal plastic material eventually defining the inner face of the package contacting the food product.

Such packages are normally made on fully automatic packaging machines, on which a continuous tube is formed from the packaging material supplied in strip form; the strip of packaging material is sterilized on the packaging machine itself, e.g. by applying a chemical sterilizing agent, such as a hydrogen peroxide solution, which, after sterilization, is removed, e.g. vaporized by heating, from the surfaces of the packaging material; and the strip of packaging material so sterilized is maintained in a closed sterile environment, and is folded and sealed longitudinally to form a vertical tube.

The tube is filled with the sterilized or sterile-processed food product, and is sealed and cut at equally spaced cross sections to form pillow packs, which are then folded mechanically to form the finished, e.g. substantially parallelepiped-shaped, packages.

Alternatively, the packaging material may be cut into blanks, which are formed into packages on forming spindles, and the resulting packages are filled with the food product and sealed. One example of such a package is the so-called "gable-top" package commonly known by the trade name Tetra Rex (registered trademark).

To open such packages, various solutions have been proposed, one of which, described in U.S. Pat. Nos. 4,655,387 and 4,410,128, consists in forming, at the corner of a flap on the package, a preferential tear line defined by a succession of perforations extending through the outer layers of the packaging material down to the layer of barrier material; and the package is opened by lifting the flap and cutting or tearing along the perforations. Packages of this type, however, cannot, obviously, be closed once opened, and must therefore be handled with care to prevent spillage of the remaining food product inside the package.

By way of a solution to the problem, packages of the type described above have been provided with closable opening devices, which substantially comprise a frame defining an opening and fitted over a hole or a pierceable or tear-off portion in a wall of the package; and a cap hinged to the frame. The cap is normally molded integrally with the frame, and is initially sealed to the frame, along a peripheral edge surrounding the opening, by a thin breakable annular connecting portion. Once unsealed, the cap is movable between a closed position cooperating in fluidtight manner with the frame, and an open position. Alternatively, threaded caps are also used, which are separate from and initially screwed to the frame.

One problem posed by such opening devices is ensuring practically no effort is required to detach the cap from the frame when unsealing the package. For which reason, the opening devices are made of low-tear-strength plastic material, normally polyethylene.

Since polyethylene, however, fails to act as an effective oxygen barrier, the side of the packaging material eventually defining the inside of the package must be fitted over the hole with an additional patch member defined by a small sheet of heat-seal plastic material; and the opposite side of the packaging material must be fitted with an oxygen-barrier member, e.g. a pull-off tongue, heat sealed to the patch member and comprising a layer of aluminium.

Providing the packages with barrier and patch members calls for additional processing of the packaging material, before this is sterilized and folded and sealed into a vertical tube, thus increasing the production time and cost of the packages.

Moreover, after unsealing the cap, the user must also remove the barrier member to open the package.

Closable opening devices have therefore been devised to enable the package to be opened in one operation, while at the same time ensuring an effective oxygen barrier.

According to the solution described in International Patent Application WO 95/05996, such opening devices substantially comprise a frame having a cylindrical collar defining a pour opening and fitted about a pierceable portion of the package; a removable cap which screws onto the outside of the frame collar to close the opening; and a substantially tubular cutting member screwed inside the frame collar and having an end edge with a number of substantially triangular end teeth, which cooperate with and partly detach the pierceable portion of the package from the relative wall, i.e. with the exception of a small-angle portion.

The cutting member is activated by the cap by means of one-way ratchet-type transmission means—operated during disengagement of the cap from the collar—and is movable in a spiral with respect to the frame from a raised rest position, in which the end teeth face the pierceable portion, into successive lowered cutting positions in which the end teeth interact with the pierceable portion.

One drawback of opening devices of the above type is that the cut part of the pierceable portion tends, in use, to at least partly clog the opening of the cutting member and, hence, the pour opening, thus obstructing outflow of the product from the package.

Also, for functional reasons, the cutting member is normally made of structurally more rigid material (e.g. polypropylene) than the frame and cap (normally made of polyethylene), with the result that the end teeth of the cutting member are highly fragile and may undergo severe damage when transporting or handling the packages, even to the extent of breaking when unsealing the package and possibly being dispersed in the food product itself.

SUMMARY OF THE INVENTION

It is an object of the present invention to provide a closable opening device for sealed packages of pourable food products, designed to eliminate the aforementioned drawbacks typically associated with known opening devices.

According to the present invention, there is provided a closable opening device for a sealed package containing a pourable food product, said device comprising:

a frame defining a through hole and fitted about a pierceable portion of said package;

a removable threaded cap which screws onto said frame to close said hole;

a tubular cutting member, which engages said hole in angularly and axially movable manner, is connected angularly to said cap at least during disengagement of the cap from said frame when first opening said package, and has an end edge in turn having, on the face, cutting means cooperating with said pierceable portion to open said package; and connecting means interposed between said frame and said cutting member, and defining a helical feed path along which the cutting member is fed through said pierceable portion;

characterized in that said cutting means comprise a single cutter acting along a major portion of the periphery of said pierceable portion.

BRIEF DESCRIPTION OF THE DRAWINGS

A preferred, non-limiting embodiment of the present invention will be described by way of example with reference to the accompanying drawings, in which:

FIG. 1 shows a view in perspective of a top portion of a sealed package for pourable food products, having a closable opening device in accordance with the present invention;

FIG. 4 shows a larger-scale exploded side view of the FIG. 1 device prior to fitment to the package;

FIG. 13 shows a larger-scale side view in perspective of a cutting member of the FIG. 1 device;

Number 1 in FIG. 1 indicates as a whole an aseptic sealed package for pourable food products, e.g. a parallelepiped-shaped package known as Tetra Brik Aseptic (registered trademark), which is made from sheet packaging material as described in detail previously, and which comprises a closable opening device 2 made of plastic material and fitted to package 1 in conventional manner, e.g. by means of adhesive substances, or using microflame or laser sealing techniques.

Figure 3:
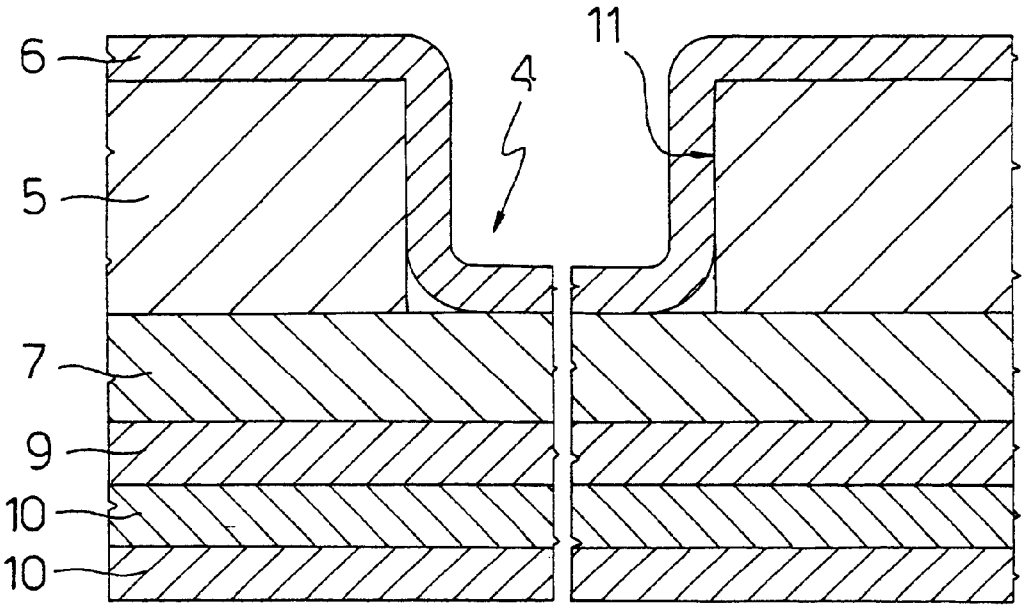
FIGS. 2 and 3 show enlarged sections, indicating the component layers, of two embodiments of the material from which the FIG. 1 package is made.
Figure 2:
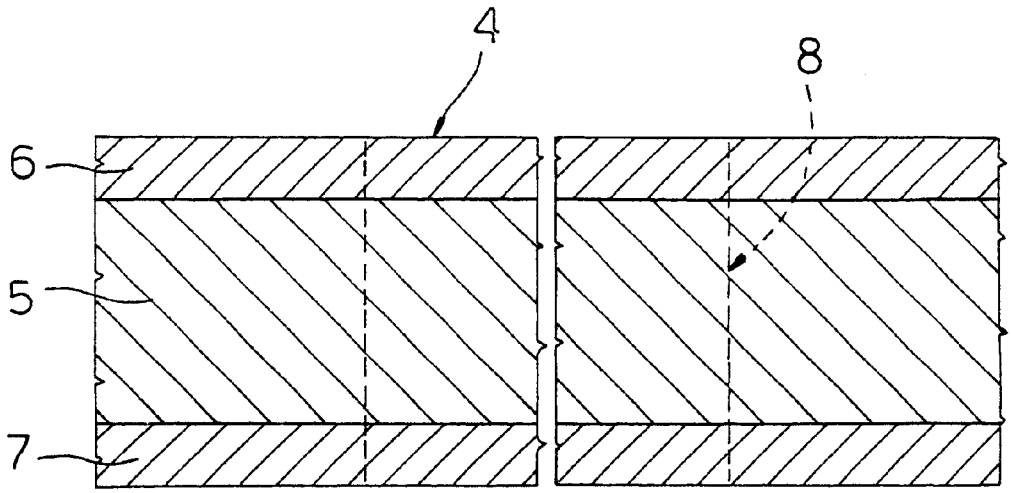
Figure 5:
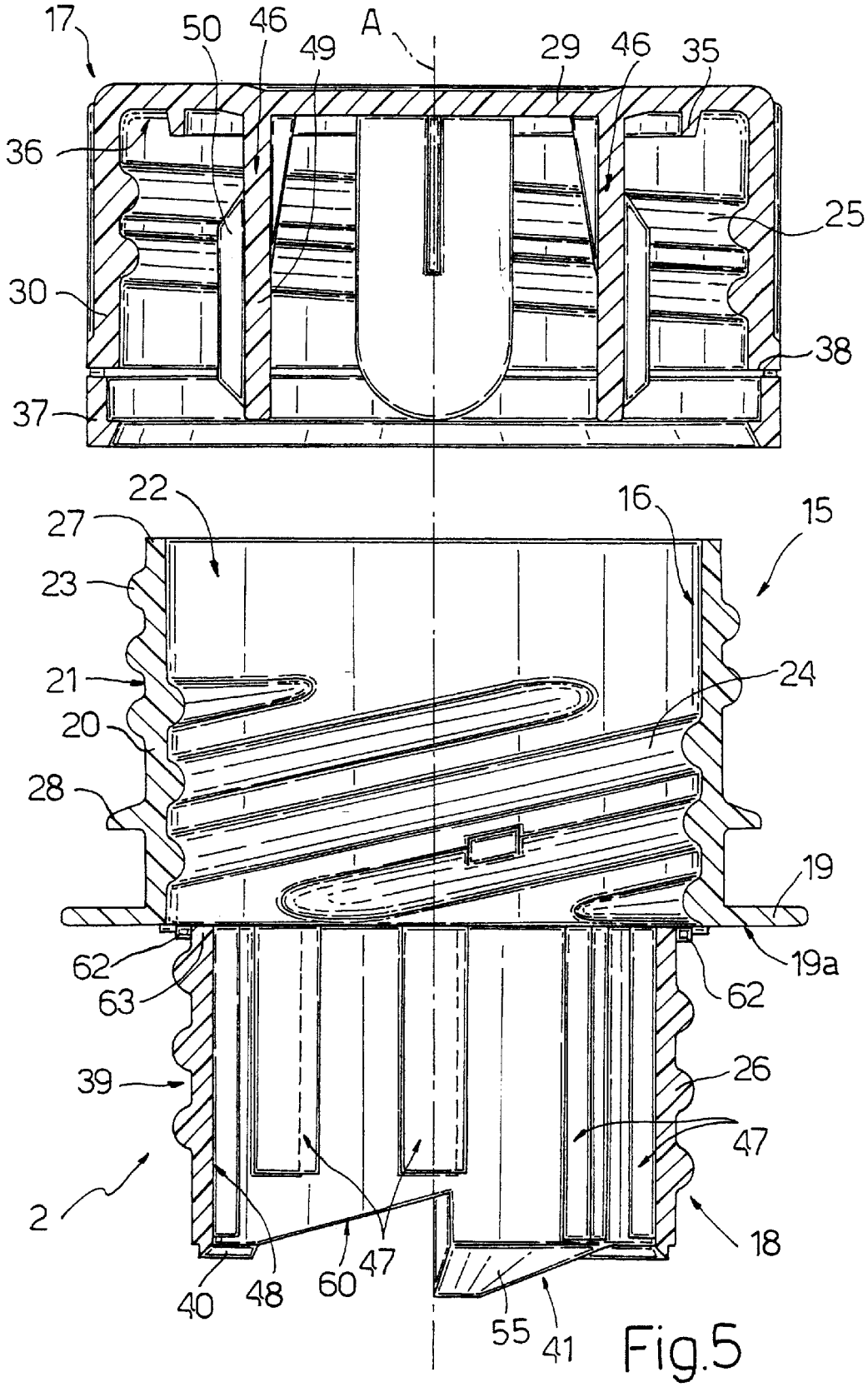
FIG. 5 shows a larger-scale exploded axial section of the FIG. 1 device prior to fitment to the package.

The packaging material (FIGS. 2 and 3) has a multilayer structure, and comprises, in a top wall 3 of package 1, a circular pierceable portion 4 of axis A, which, in use, is covered externally by opening device 2 and is detached at least partly from wall 3 to pour the product out of package 1.

In the case of nonaseptic packages for pasteurized products (e.g. yoghurt, cream and other cold-range products), the packaging material comprises a layer of fibrous material 5, normally paper, covered on the outer and inner sides with respective layers of thermoplastic material 6, 7, e.g. polyethylene (FIG. 2); and pierceable portion 4 is defined by a preferential tear line 8 formed in the layer of fibrous material 5 and defined by a succession of perforations.

In the case of aseptic packages for long-storage products such as UHT milk, the packaging material also comprises, on the side eventually contacting the food product in package 1, i.e. on the layer of thermoplastic material 7, a layer of barrier material 9, e.g. aluminium, in turn covered with one or more layers of thermoplastic material 10 (FIG. 3); and pierceable portion 4 is defined by respective portions of the layers of thermoplastic material 6, 7, 10 and barrier material 9 covering a hole 11, of axis A, formed in the layer of fibrous material 5.

With reference to FIGS. 4–8, opening device 2 comprises a frame 15 defining a through hole 16 of axis A, through which the food product is poured, and fitted about pierceable portion 4 on wall 3 of package 1; a cap 17 formed separately from frame 15 and fitted coaxially onto frame 15 to close hole 16; and a tubular cutting member 18 of axis A, which engages hole 16 in axially and angularly movable manner and is activated by cap 17 to interact with pierceable portion 4 of wall 3 to open package 1.

More specifically, frame 15 comprises a circular annular base flange 19, an end surface 19*a* of which is fitted about pierceable portion 4 on wall 3 of package 1, and from the radially inner edge of which projects axially a cylindrical collar 20 of axis A defining hole 16.

On respective opposite lateral surfaces 21, 22, collar 20 comprises an outer thread 23 and an inner thread 24, which slope in opposite directions with respect to axis A, and, in use, respectively engage a thread 25 of cap 17 and a thread 26 of cutting member 18. More specifically, thread 23 extends along most of surface 21, except for a bottom cylindrical band of surface 21 adjacent to flange 19; and, similarly, thread 24 extends along most of surface 22, except for a top cylindrical band of surface 22 adjacent to an end edge 27 of collar 20 at the opposite end to flange 19.

Thread 24 is a multiple—in the example shown, a triple—thread of a pitch greater than that of thread 23.

Collar 20 also comprises, on surface 21, an annular rib 28 interposed axially between one end of thread 23 and flange 19, and located a constant axial distance from flange 19.

With reference to FIGS. 4–8 and 12, cap 17 comprises a hollow cylindrical body defined by a circular end wall 29 for closing hole 16, and by a cylindrical lateral wall 30 projecting from a peripheral edge of end wall 29, and which comprises thread 25 inside and screws onto collar 20 of frame 15.

End wall 29 comprises a projecting annular rib 35 adjacent to lateral wall 30 and defining, with lateral wall 30, a seat 36 for receiving end edge 27 of collar 20.

Cap 17 is molded integrally, in the usual way, with a respective tamperproof ring 37 connected coaxially to an end edge 38 of cap 17, at the opposite end to end wall 29, by a number of breakable radial connecting points.

Cap 17 is fitted initially to frame 15 in a sealed position, wherein the cap is screwed completely onto collar 20, with end edge 38 of the cap and tamperproof ring 37 still connected to each other and resting on opposite sides of rib 28 of collar 20. More specifically, in the sealed position, tamperproof ring 37 is clicked between flange 19 and rib 28, and seat 36 of cap 17 is engaged by end edge 27 of collar 20.

Once unsealed, cap 17 is movable between an open position, in which it is unscrewed off collar 20 and detached from frame 15, and a closed position closing hole 16.

With reference to FIGS. 4–8, 13 and 14, cutting member 18, having thread 26 on an outer surface 39, is connected inside collar 20 of frame 15 by thread 26 engaging thread 24, and has an end edge 40 having, on the face, cutting means 41 which cooperate with pierceable portion 4 to open package 1.

Figure 8:
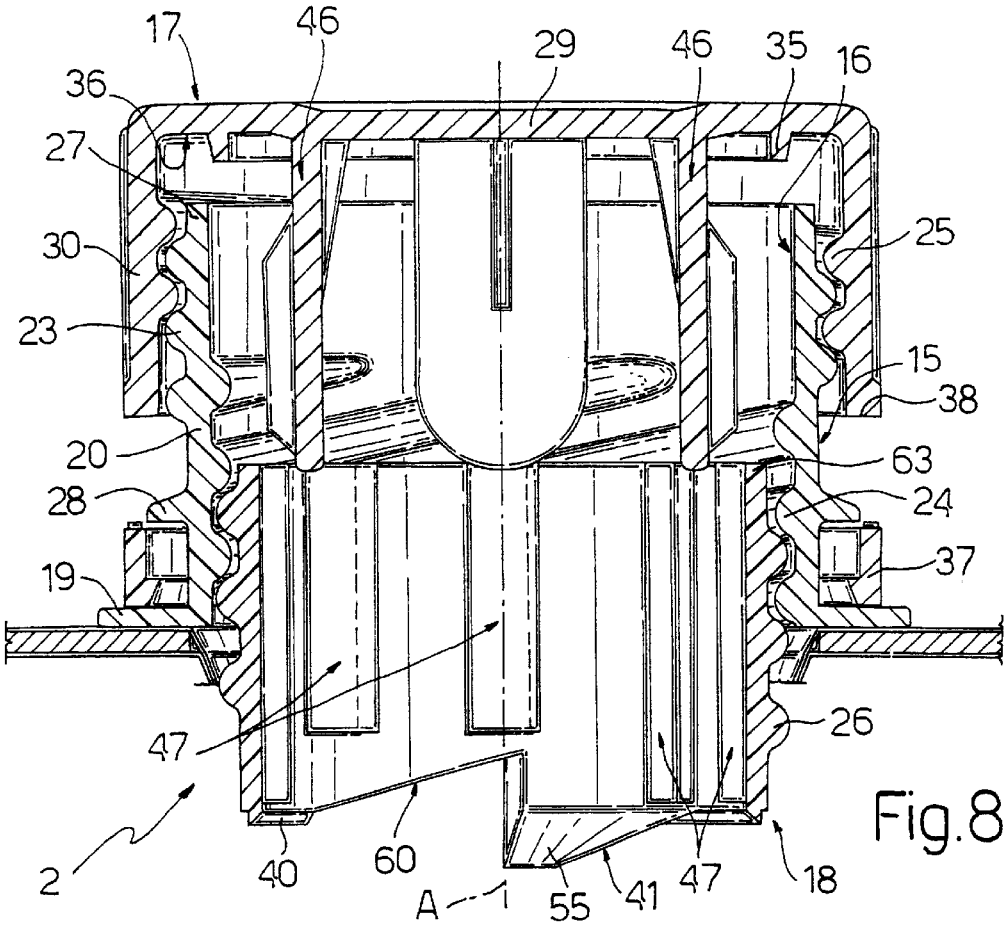
FIG. 8 shows a larger-scale axial section of the FIG. 1 device as the package is being opened.
Figure 12:
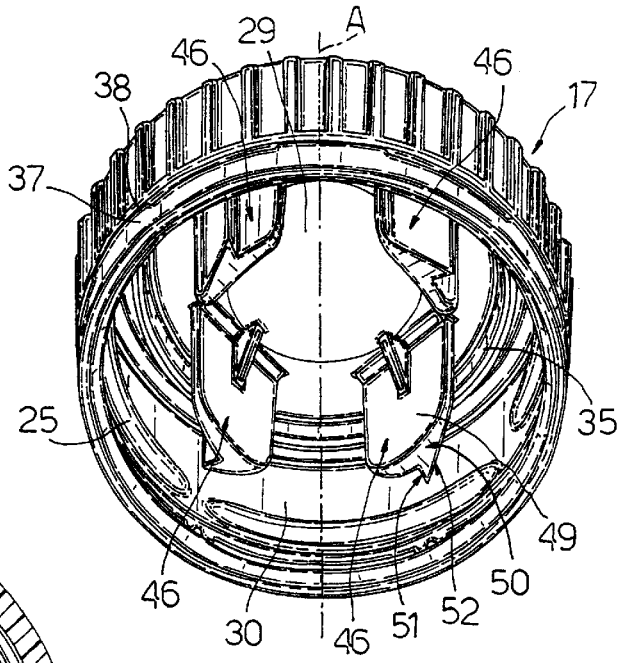
FIG. 12 shows a larger-scale underside view in perspective of a cap of the FIG. 1 device.
Figure 7:
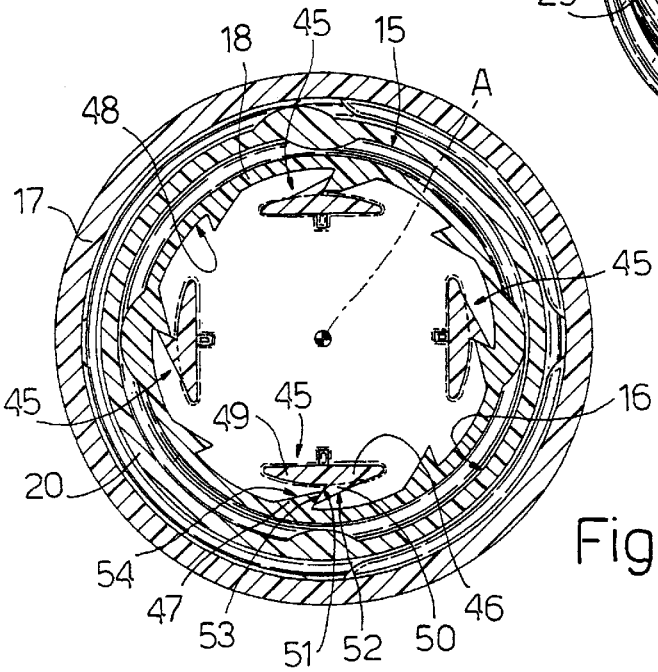
FIG. 7 shows a section along line VII—VII in FIG. 6.
Figure 11:
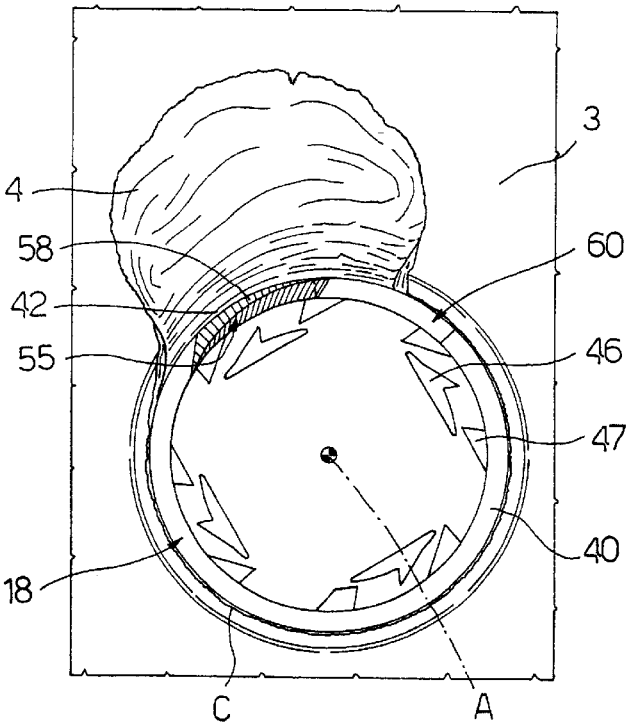

When first opening package 1, threads 24 and 26 define a spiral path, of axis A, along which cutting member 18 is fed through pierceable portion 4 from a raised rest position (FIGS. 6 and 9) to a lowered opening position (FIGS. 8 and 11). More specifically,in the raised rest position, cutting member 18 is housed entirely inside collar 20, with cutting means 41 facing pierceable portion 4 of package 1; and, in the lowered opening position, cutting member 18 projects axially with respect to collar 20, has penetrated a predetermined distance inside package 1, and has completed the cutting of pierceable portion 4, leaving the pierceable portion attached to wall 3 by a small-angle portion 42.

Cutting member 18 comprises a number of stop projections 44 projecting radially from surface 39 at end edge 40. In the event cap 17 is turned the wrong way when opening package 1, i.e. is turned in the direction screwing cap 17 onto frame 15, projections 44 come to rest against an end of thread 24 of collar 20 adjacent to flange 19 to prevent axial displacement of cutting member 18 beyond the raised rest position and possible damage to end wall 29 of cap 17.

Displacement of cutting member 18 from the raised to the lowered position is controlled by cap 17 via one-way angular transmission means 45 (FIGS. 5–8, 12), which can be selectively deactivated once cutting member 18 reaches the lowered opening position.

More specifically, transmission means 45 comprise a number of—in the example shown, four—first teeth 46 having a sawtooth profile, projecting from end wall 29 of—cap 17, and equally spaced angularly about axis A in the sealed and closed positions of cap 17; and a number of in the example shown, eight—second teeth 47 also having a sawtooth profile, projecting radially from an inner surface 48 of cutting member 18, and which mesh with teeth 46 in axially-free, angularly-integral manner during disengagement of cap 17 from collar 20 when first opening package 1. More specifically, said disengagement of cap 17 is indicated in FIG. 1 by the anticlockwise rotation direction R of cap 17 about axis A.

More specifically, each tooth 46 comprises a connecting portion 49 projecting perpendicularly from end wall 29 of cap 17; and a meshing portion 50 projecting from connecting portion 49 towards lateral wall 30, and having a cross section in the form of an obtuse triangle. More specifically, meshing portion 50 is defined by two oblique, outwardly-converging sides 51, 52; the side (51) sloping more steeply with respect to connecting portion 49 defines a seat for a respective tooth 47 in the rotation direction R of cap 17; and the other side (52) permits angular slide of teeth 47 in the opposite rotation direction.

Each tooth 47 extends the full axial height of cutting member 18, and also has a cross section in the form of an obtuse triangle identical to that of meshing portions 50 of teeth 46 and defined by two oblique, converging sides 53, 54; and the side (53) sloping more steeply with respect to surface 48 of cutting member 18 faces side 51 of a respective tooth 46.

According to an important characteristic of the present invention, cutting means 41 comprise a single cutter 55, which, as cutting member 18 is moved with respect to frame 15, cuts along a major portion C—in the example shown, roughly three-quarters—of the periphery of pierceable portion 4 to detach pierceable portion 4 from wall 3 only partly, i.e. all but portion 42.

Figure 14:
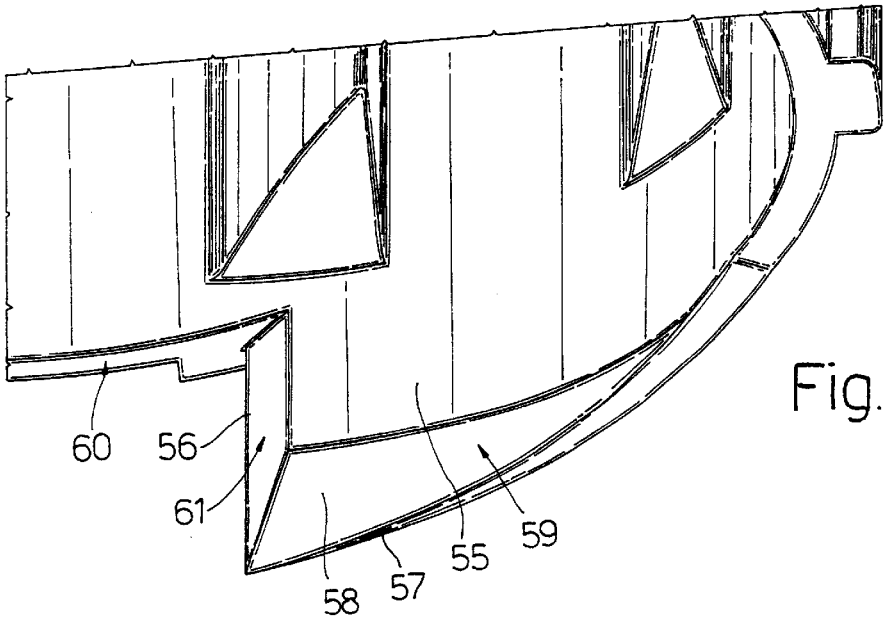
FIG. 14 shows a larger-scale side view of a detail of the FIG. 13 cutting member.

With particular reference to FIG. 14, cutter 55 is defined by a tooth formed on end edge 40 of cutting member 18 and having a substantially triangular profile defined by a cutting edge 56 crosswise to pierceable portion 4 of wall 3, and by a lateral cutting edge 57 having a curved profile sloping with respect to axis A and connecting a free end of cutting edge 56 to end edge 40.

More specifically, cutter 55 comprises a cutting portion 58 projecting axially with respect to end edge 40 and defined, inwards of cutting member 18, by a surface 59 sloping slightly with respect to pierceable portion 4 so as to define a cross section of cutting portion 58 decreasing towards pierceable portion 4.

Adjacent to cutter 55, end edge 40 of cutting member 18 has a ramp-shaped recess 60 increasing in depth towards cutter 55, and defining an axial height of cutting edge 56 greater than the axial height of cutting portion 58.

In a preferred embodiment, frame 15 and cutting member 18 are molded in one piece and connected coaxially to each other, by a number of breakable radial connecting bridges 62, in a preassembly configuration (FIGS. 4 and 5) in which cutting member 18 projects axially and completely with respect to frame 15 at the flange 19 end. More specifically, in the preassembly configuration, cutting member 18 is aligned axially with flange 19 at an end edge 63 of the cutting member opposite end edge 40, and is connected by connecting bridges 62 to the inner lateral edge of flange 19 at surface 19*a*.

Before being fitted to pierceable portion 4 of package 1, opening device 2 is assembled by inserting cutting member 18 inside collar 20, thus breaking connecting bridges 62, and by simultaneously or subsequently fitting cap 17 to frame 15.

More specifically, in the course of inserting cutting member 18 inside collar 20, threads 24 and 26 engage mutually, and teeth 47 slide axially in twos on opposite angular sides of meshing portion 50 of a respective tooth 46. Connecting bridges 62, which are broken during insertion, ensure correct mutual angular positioning of cutting member 18 and frame 15.

Cap 17 is preferably fitted to frame 15 by applying axial pressure, after first setting cap 17 to a predetermined angular position with respect to cutting member 18, so that threads 23 and 25 engage mutually, and tamperproof ring 37 clicks past annular rib 28 of collar 20 onto flange 19. Alternatively, cap 17 may be assembled by first applying axial pressure and then screwing cap 17 onto collar 20 of frame 15 and into a final angular position enabling full use of the unscrewing movement of cap 17 when opening package 1.

Figure 6:
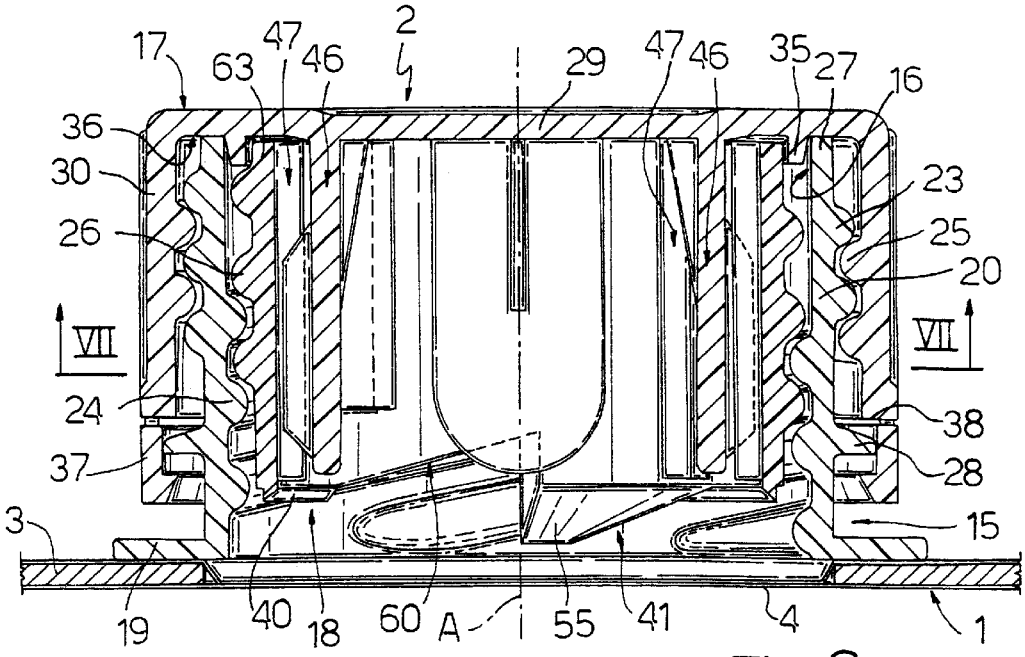
FIG. 6 shows a larger-scale axial section of the FIG. 1 device fitted to the package in a sealed configuration.

At the end of the above operations, cutting member 18 is in the raised rest position inside collar 20, and defines, together with cap 17 positioned closing hole 16, a sealed configuration securing opening device 2 to package 1 (FIG. 6).

In actual use, as of the above sealed configuration, package 1 is unsealed by turning cap 17, with respect to axis A, in direction R to unscrew the cap off collar 20.

As cap 17 is turned about axis A in direction R, mating threads 23 and 25 simultaneously move cap 17 axially away from wall 3 so as to break the radial points connecting the cap to tamperproof ring 37, which is retained resting axially against rib 28 of collar 20.

During initial rotation of cap 17, teeth 46 are positioned with sides 51 resting against sides 53 of respective teeth 47 of cutting member 18, which is thus rotated about axis A in direction R.

By virtue of mating threads 23, 25 and 24, 26 sloping in opposite directions, the axial movement of cap 17 away from wall 3 of package 1 is accompanied by a simultaneous axial movement of cutting member 18 towards wall 3. More specifically, cutting member 18 is rotated by cap 17 by teeth 46 and 47 contacting at respective sides 51, 53, which, however, are simultaneously caused to slide axially with respect to each other by the spiral movement imposed on cap 17 and cutting member 18 by respective pairs of threads 23, 25 and 24, 26.

Figure 9:
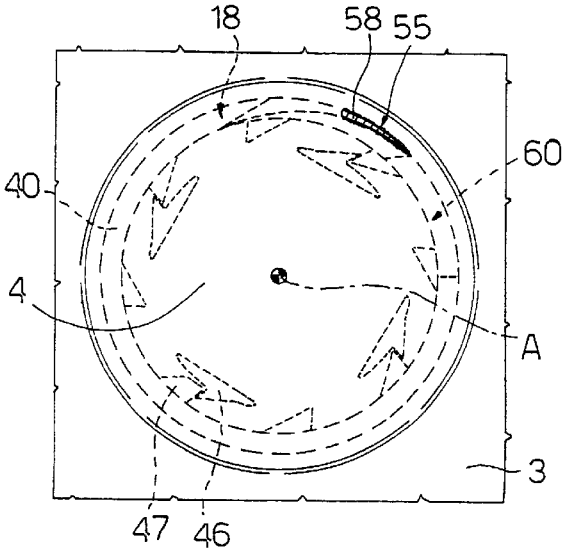
FIGS. 9 to 11 show views, from inside the package, of the FIG. 1 device at successive stages in the opening of the package.

Initial rotation of cap 17 about axis A in direction R results in equal rotation of cutting member 18 and, at the same time, in axial penetration of pierceable portion 4 by cutting portion 58 of cutter 55 (FIG. 9).

Figure 10:
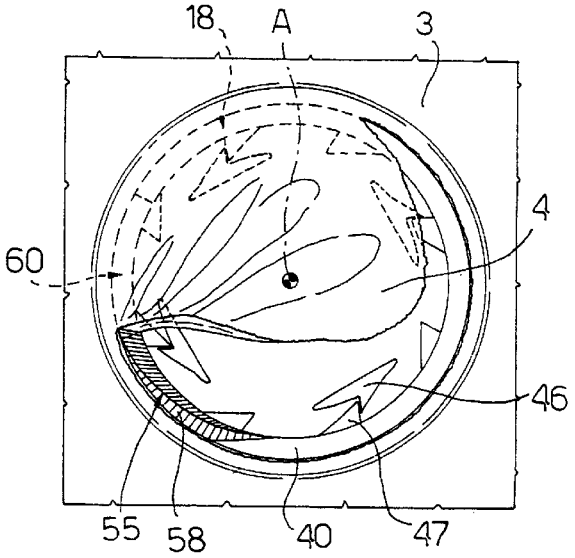

As cap 17 is rotated further, cutting edge 56 of cutter 55 is fed angularly along the periphery of pierceable portion 4 to detach it from wall 3. As shown in FIG. 10, by virtue of cutter 55 also penetrating axially as it is fed forward angularly, the part of pierceable portion 4 gradually detached from wall 3 puckers close to cutting edge 56 and is gradually folded inwards of package 1 towards the part of pierceable portion 4 not yet detached from wall 3. This is further assisted by the slope of surface 59 defining cutting portion 58 inwards of cutting member 18.

At this stage, by virtue of recess 60, axial penetration of pierceable portion 4 by cutter 55 is greater than the axial height of cutting portion 58 of cutter 55.

Once package 1 is penetrated axially by cutter 55 to the extent that pierceable portion 4 contacts the bottom of recess 60—in the example shown, when cutter 55 reaches the end of portion C of the periphery of pierceable portion 4, equal to an angular displacement of about 270° about axis A—further rotation of cutter 55 about axis A simply serves to fold the remainder of pierceable portion 4, still attached to wall 3, outwards of cutting member 18 without cutting it (FIG. 11).

Further unscrewing of cap 17—which, by now, has made roughly one turn about axis A—axially releases teeth 46 and 47 (FIG. 8) so that cutting member 18 is arrested in the lowered open position projecting axially from frame 15 and still secured to collar 20 by mating threads 24 and 26.

Cap 17 is then unscrewed fully to open package 1, which may be closed by simply fitting cap 17 back onto collar 20.

Once package 1 has been opened, cutting member 18 can no longer be moved from the lowered open position, on account of teeth 46 of cap 17 being unable to reach an axial position in which to engage teeth 47 of cutting member 18, so that the cut part of pierceable portion 4 is kept on the outside of cutting member 18, thus keeping hole 16 clear.

The advantages of opening device 2 according to the present invention will be clear from the foregoing description.

In particular, tests have shown that using a single cutter 55, movable in a spiral and acting along a major portion (C) of the periphery of pierceable portion 4 of package 1, provides not only for cutting but also for exerting thrust on and folding the cut part of pierceable portion 4 inwards of package 1, as well as outwards of and eventually about cutting member 18, thus preventing the cut part of pierceable portion 4 from interfering with outflow of the product from package 1.

Using a single cutter 55 also provides for a high degree of efficiency of cutting member 18, which may therefore be made of not particularly rigid materials, e.g. the same material as cap 17 and frame 15, and may advantageously be molded in one piece with frame 15, as stated in the foregoing description.

Clearly, changes may be made to opening device 2 as described and illustrated herein without, however, departing from the scope of the accompanying claims.

What is claimed is:

1. A closable opening device for a sealed package containing a pourable food product, said device comprising:

a frame defining a through hole and fitted about a pierceable portion of said package;

a removable threaded cap which screws onto said frame to close said hole;

a tubular cutting member which engages said hole in angularly and axially movable manner, is connected angularly to said cap at least during disengagement of the cap from said frame when first opening said package, and has an end edge in turn having, on the face, cutting means cooperating with said pierceable portion to open said package;

connecting means interposed between said frame and said cutting member, and defining a helical feed path along which the cutting member is fed through said pierceable portion; and wherein said cutting means comprise a single cutter acting along a major portion of the periphery of said pierceable portion.

2. A device as claimed in claim 1, wherein said cutter comprises a cutting portion projecting axially with respect to said end edge, and is movable along the periphery of said pierceable portion with a predetermined axial penetration greater than the axial height of said cutting portion.

3. A device as claimed in claim 2, wherein said cutter comprises a cutting edge crosswise to said pierceable portion; and a further cutting edge angularly defining said cutting portion and extending crosswise from a free end of said cutting edge.

4. A device as claimed in claim 3, wherein said end edge of said cutting member comprises, adjacent to said cutter, a ramp-shaped recess increasing in depth towards the cutter and defining an axial height of said cutting edge greater than the axial height of said cutting portion.

5. A device as claimed in claim 1, wherein said cutter has a substantially triangular profile.

6. A device as claimed in claim 2, wherein said cutting portion is defined, inwards of said cutting member, by a first oblique surface sloping with respect to said pierceable portion and defining a cross section of said cutting portion decreasing towards the pierceable portion.

7. A device as claimed in claim 3, wherein said cutting edge is defined by a second oblique surface facing inwards of said cutting member.

8. A closable opening device for a sealed package containing a pourable food product, said device comprising:

a frame defining a through hole and fitted about a pierceable portion of said package;

a removable threaded cap which screws onto said frame to close said hole;

a tubular cutting member which engages said hole in angularly and axially movable manner, is connected angularly to said cap at least during disengagement of the cap from said frame when first opening said package, and has an end edge in turn having, on the face, cutting means cooperating with said pierceable portion to open said package; connecting means interposed between said frame and said cutting member, and defining a helical feed path along which the cutting member is fed through said pierceable portion; and wherein said cutting means comprise a single cutter acting along a major portion of the periphery of said pierceable portion and said frame comprises a cylindrical collar for receiving said cap and defining said hole; and said connecting means comprise a first and a second thread engaging each other and formed on respective lateral surfaces of said collar and said cutting member respectively.

9. A device as claimed in claim 8, wherein said collar comprises, on a lateral surface opposite the lateral surface having said first thread, a third thread sloping in the opposite direction to the first thread and which engages a fourth thread formed on said cap.

10. A device as claimed in claim 9, wherein first and second thread have a pitch greater than the pitch of said third and fourth thread.

11. A closable opening device for a sealed package containing a pourable food product, said device comprising:

a frame defining a through hole and fitted about a pierceable portion of said package;

a removable threaded cap which screws onto said frame to close said hole;

a tubular cutting member which engages said hole in angularly and axially movable manner, is connected angularly to said cap at least during disengagement of the cap from said frame when first opening said package, and has an end edge in turn having, on the face, cutting means cooperating with said pierceable portion to open said package; connecting means interposed between said frame and said cutting member, and defining a helical feed path along which the cutting member is fed through said pierceable portion; and a one-way angular transmission means interposed between said cap and said cutting member.

12. A device as claimed in claim 11, wherein said transmission means comprise a number of first teeth having a substantially sawtooth profile and projecting radially from a lateral surface of said cutting member opposite the lateral surface having said second thread; and a number of second teeth also having a substantially sawtooth profile, and which are carried by said cap and mesh with said first teeth in axially-free, angularly-integral manner during said disengagement of said cap from said frame when first opening said package.

13. A closable opening device for a sealed package containing a pourable food product, said device comprising:

a frame defining a through hole and fitted about a pierceable portion of said package;

a removable threaded cap which screws onto said frame to close said hole;

a tubular cutting member which engages said hole in angularly and axially movable manner, is connected angularly to said cap at least during disengagement of the cap from said frame when first opening said package, and has an end edge in turn having, on the face, cutting means cooperating with said pierceable portion to open said package; connecting means interposed between said frame and said cutting member, and defining a helical feed path along which the cutting member is fed through said pierceable portion; and wherein said frame and said cutting member are molded in one piece in a preassembly configuration, in which they are secured coaxially to each other by breakable connecting means.

14. A device as claimed in claim 1, having at least one additional cutter which acts on a minor portion of the periphery.

* * * * *

UNITED STATES PATENT AND TRADEMARK OFFICE

CERTIFICATE OF CORRECTION

PATENT NO. : 6,279,779 B1
DATED : November 12, 2002
INVENTOR(S) : Leslie Falkingham et al.

It is certified that error appears in the above-identified patent and that said Letters Patent is hereby corrected as shown below:

This certificate supersedes Certificate of Correction issued April 15, 2003, the number was erroneously mentioned and should be vacated since no Certificate of Correction was granted.

Signed and Sealed this

Twenty-sixth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,279,779 B1
DATED : November 12, 2002
INVENTOR(S) : Leslie Falkingham et al.

It is certified that error appears in the above-identified patent and that said Letters Patent is hereby corrected as shown below:

This certificate supersedes Certificate of Correction issued April 15, 2003, the number was erroneously mentioned and should be vacated since no Certificate of Correction was granted.

Signed and Sealed this

Second Day of September, 2003

JAMES E. ROGAN
*Director of the United States Patent and Trademark Office*